US009383158B1

(12) United States Patent
Khoshnood

(10) Patent No.: US 9,383,158 B1
(45) Date of Patent: Jul. 5, 2016

(54) ARCHERY BOW VIBRATION DAMPENING DEVICE

(71) Applicant: AXION ARCHERY LLC, Alpharetta, GA (US)

(72) Inventor: Bahram Khoshnood, Alpharetta, GA (US)

(73) Assignee: Axion Archery LLC, Alpharetta, GA (US)

( * ) Notice: Subject to any disclaimer, the term of this patent is extended or adjusted under 35 U.S.C. 154(b) by 0 days.

(21) Appl. No.: 14/959,503

(22) Filed: Dec. 4, 2015

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 6,257,220 B1 * 7/2001 McPherson ..... F41B 5/1426 124/23.1
6,298,842 B1 * 10/2001 Sims ..... F41B 5/1426 124/89
6,382,201 B1 * 5/2002 McPherson ..... F41B 5/0005 124/23.1
6,684,874 B2 * 2/2004 Mizek ..... F41B 5/1426 124/89
6,745,757 B2 * 6/2004 Sims ..... F41B 5/1426 124/89
6,761,158 B2 * 7/2004 Wright ..... F41B 5/1407 124/92
6,802,307 B2 * 10/2004 Leven ..... F41B 5/1426 124/89
6,910,472 B2 * 6/2005 Mizek ..... F41B 5/1426 124/89
7,703,449 B2 * 4/2010 Wright ..... F41B 5/1426 124/89
7,793,645 B2 * 9/2010 Walk ..... F41B 5/066 124/89
8,166,963 B2 * 5/2012 Leven ..... F41B 5/1426 124/86
8,225,778 B2 * 7/2012 Walk ..... F41B 5/066 124/89
8,281,777 B2 * 10/2012 Bach ..... F41B 5/1426 124/87
8,534,273 B2 * 9/2013 LoRocco ..... F41B 5/1426 124/86
8,573,193 B2 * 11/2013 Khoshnood ..... F41B 5/1426 124/86
8,590,522 B2 * 11/2013 Khoshnood ..... F41B 5/1426 124/86
8,656,899 B2 * 2/2014 Bednar ..... F41B 5/12 124/25
8,833,356 B2 * 9/2014 Khoshnood ..... F41B 5/1426 124/86

(Continued)

*Primary Examiner* — Alexander Niconovich
(74) *Attorney, Agent, or Firm* — Rodgers & Rodgers

(57) ABSTRACT

An archery bow vibration dampening device of resilient material including a base with a pair of stems extending outwardly from the sides of the base and with multiple studs extending outwardly from the periphery of the stems. Openings are formed in the studs with weights disposed in the openings. An outer ring extends around the periphery of the base for attachment of the device to a motion dampening assembly.

9 Claims, 7 Drawing Sheets

(56) References Cited

U.S. PATENT DOCUMENTS 8,893,700 B2 * 11/2014 Kozlik ..... F41B 5/1426 124/23.1
8,931,470 B1 * 1/2015 Khoshnood ..... F41B 5/1426 124/89
8,939,139 B2 * 1/2015 Sims ..... F41B 5/1426 124/89
8,991,380 B2 * 3/2015 Bednar ..... F41B 5/12 124/25
9,032,947 B2 * 5/2015 Bidigare ..... F41B 5/1426 124/89
9,038,617 B1 * 5/2015 Khoshnood ..... F41B 5/1426 124/89
2003/0094168 A1 * 5/2003 Sims ..... F41B 5/1426 124/89
2006/0102441 A1 * 5/2006 Nease ..... F16F 7/108 188/378
2006/0180135 A1 * 8/2006 Andrews ..... F41B 5/1426 124/89
2009/0032005 A1 * 2/2009 Wright ..... F41B 5/1426 124/89
2010/0242940 A1 * 9/2010 Leven ..... F41B 5/1426 124/89
2010/0319670 A1 * 12/2010 Sims ..... F41B 5/1426 124/89
2012/0125308 A1 * 5/2012 Khoshnood ..... F41B 5/1426 124/89
2012/0125309 A1 * 5/2012 Khoshnood ..... F41B 5/1426 124/89
2012/0125310 A1 * 5/2012 Khoshnood ..... F41B 5/1426 124/89
2012/0167864 A1 * 7/2012 Sims ..... F16F 1/373 124/86
2012/0240913 A1 * 9/2012 Stokes ..... F41B 5/1426 124/89
2013/0118468 A1 * 5/2013 Kozlik ..... F41B 5/1426 124/89
2015/0034063 A1 * 2/2015 Bidigare ..... F41B 5/1426 124/89
2015/0316343 A1 * 11/2015 Simonds ..... F41B 5/1426 124/89

* cited by examiner

ARCHERY BOW VIBRATION DAMPENING DEVICE

BACKGROUND OF THE INVENTION

In modern archery bows, a great deal of energy is stored in the bow for the purpose of launching arrows. The amount of energy transferred to the arrow is dependent on the weight of the arrow with the majority of the energy absorbed in the process of shooting a heavy arrow and to a substantially lesser extent when shooting a lighter weight arrow. The residual energy is absorbed by the bow which results in a variable amount of bow shock and vibration which adversely affects the comfort of the archer and accuracy of the archery shot. The problem of archery bow vibration has been addressed in a variety of ways by employing a variety of archery bow vibration reduction devices with varying degrees of success.

BRIEF SUMMARY OF THE INVENTION

An archery bow vibration dampening device for use in a wide variety of applications includes a unitary dampener having a circular base with an outer ring extending around the periphery of the base. A pair of stems extend coaxially outward, respectively, from opposite sides of the base. Multiple studs extend laterally outward from each stem with an opening formed in each stud with a weight insertable into each opening to provide added vibration reduction resulting from the firing of an arrow from the archery bow.

DETAILED DESCRIPTION OF THE INVENTION

Figure 6:
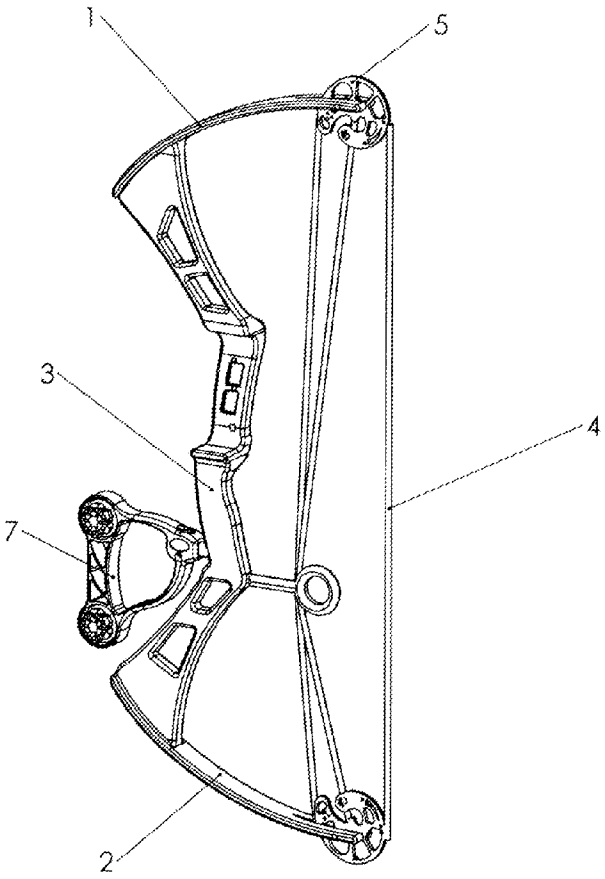
FIGS. 6 and 7 depict a further application of the invention.

With particular reference to FIG. 6, a conventional compound archery bow is shown and includes flexible limbs 1 and 2 affixed to and extending outwardly from riser 3. Bow string 4 extends around cams 5 and 6 which are affixed to the three ends of flexible limbs 1 and 2, respectively, as is well known. One application of the vibration dampening device, according to this invention, is shown in FIG. 6 in the form of vibration modifier 7.

Figure 1:
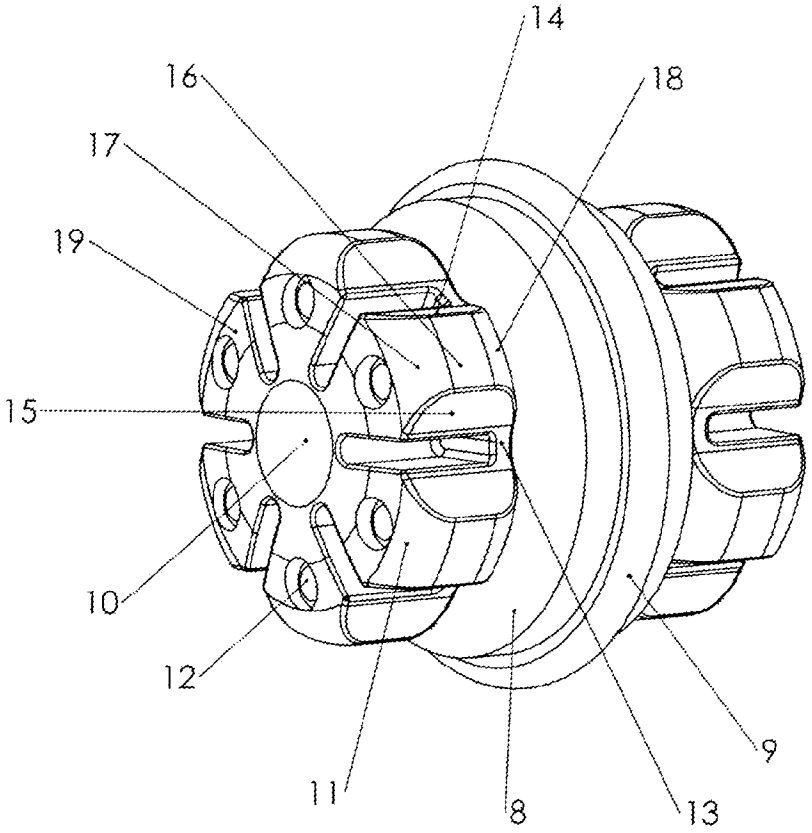
FIG. 1 is a perspective view of the archery bow vibration and dampening device according to this invention.
Figure 2:
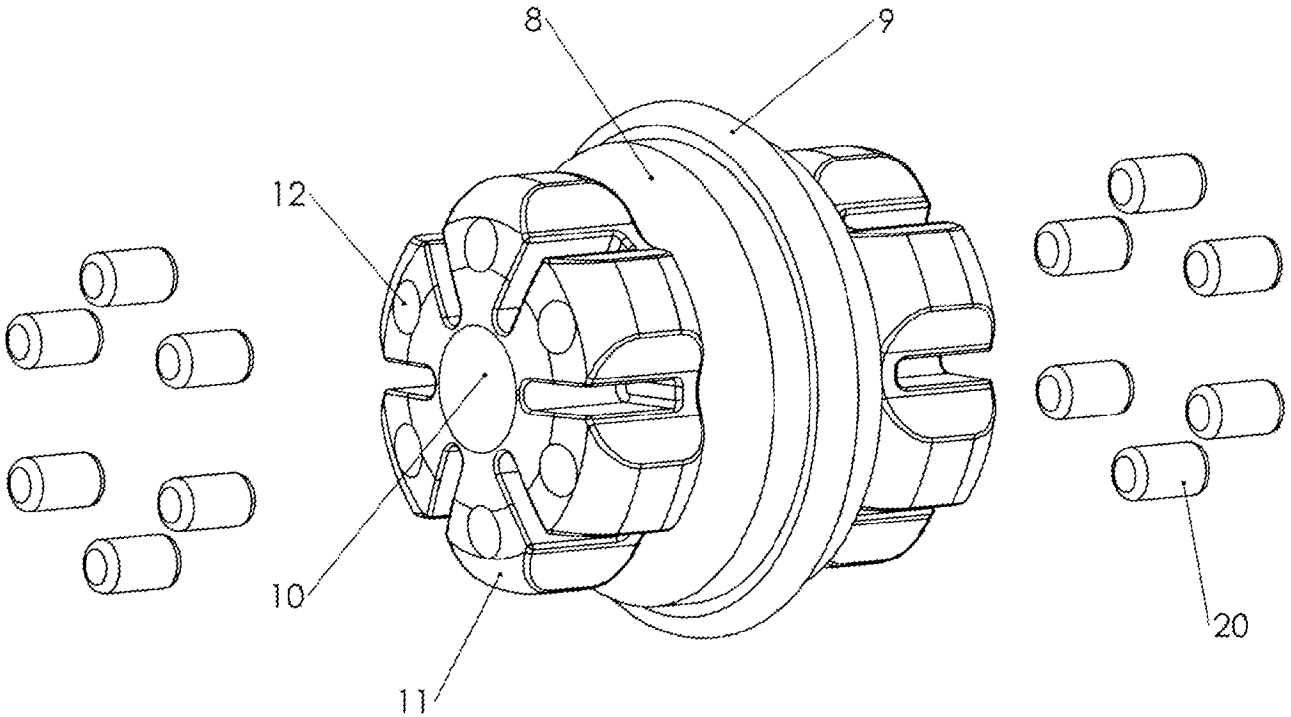
FIG. 2 is a perspective view similar to FIG. 1 showing the added weight feature of this invention.

With particular reference to FIGS. 1 and 2, the archery bow vibration dampening device, according to this invention, is shown and includes circular base 8 with outer ring 9 extending around the circumference of base 8. Stem 10 extends coaxially outwardly from the center of one side of base 8. Multiple studs 11 extend laterally outward from stem 10 and opening 12 is formed in the outer wall of each stud 11. Further, the bottom edge of each stud 11 is joined to disc 13. Although not shown in detail in the drawings, the same structure is disposed on the opposite side of base 8.

Each stud 11 includes upwardly angled side walls 14, 15 with top wall 16 extending therebetween. Side walls 17 and 18 extend downwardly from the side edges, respectively, of top wall 16 and are disposed between side walls 14 and 15. Side walls 14, 15, 17 and 18 are angled upwardly and inwardly and extend, respectively, from the outer free edges of V-shaped pedestal 19.

Although the vibration dampening device, according to this invention, can be manufactured of any suitable material, optimally the device is fabricated from soft compound rubber. Also, all the elements shown in FIG. 1 are integrally joined together to provide the optimal vibration dampening characteristics.

As shown in FIG. 2, the weight of the vibration and dampening device shown in FIG. 1 can be varied to accommodate the requirements and preferences of the archer. In this manner, weights 20 are insertable into openings 12 in varying numbers and location combinations. Weights 20 are shown in FIG. 2 as being cylindrical, but other shapes can be utilized such as spherical, oblong and other like shapes. Weights 20 are preferably constructed of metal, although other materials are adaptable for use in the vibration dampening device as desired.

Figure 3:
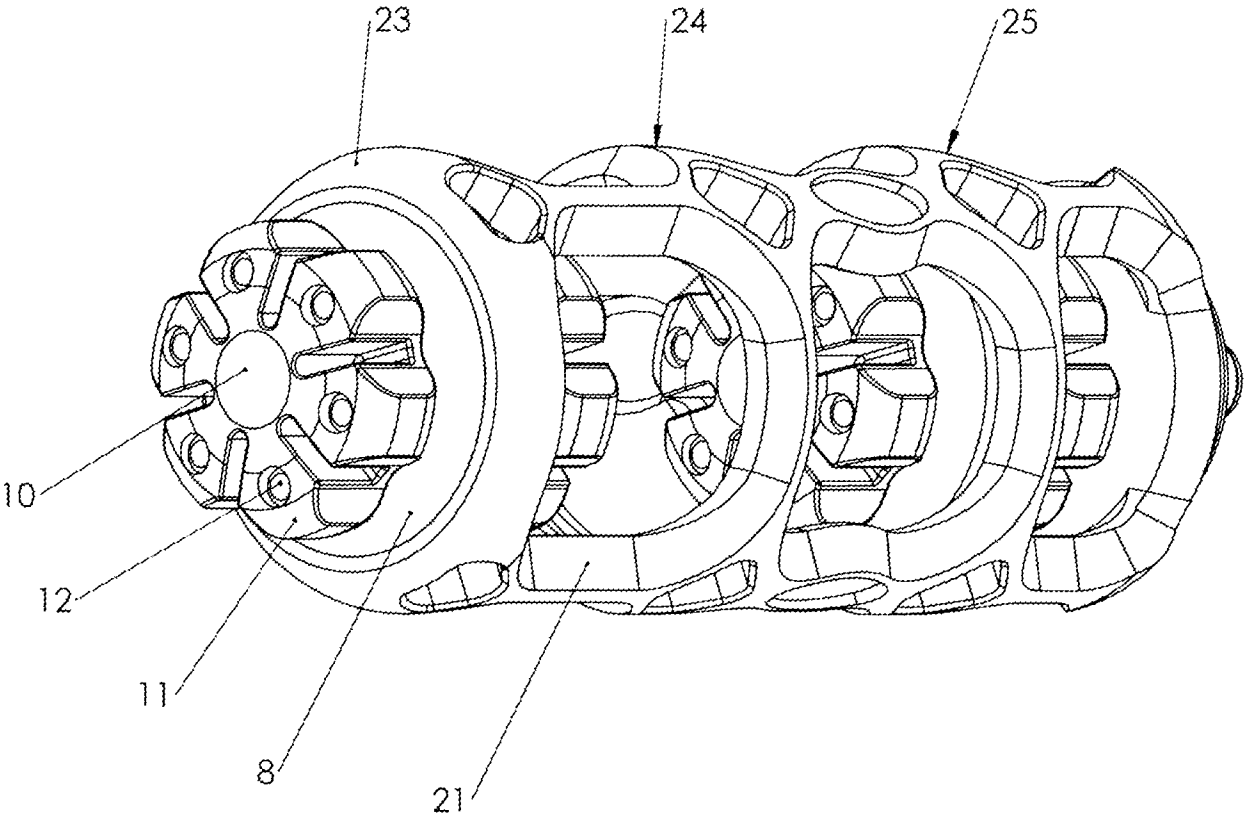
FIG. 3 is a perspective view of one application of the invention.
Figure 4:
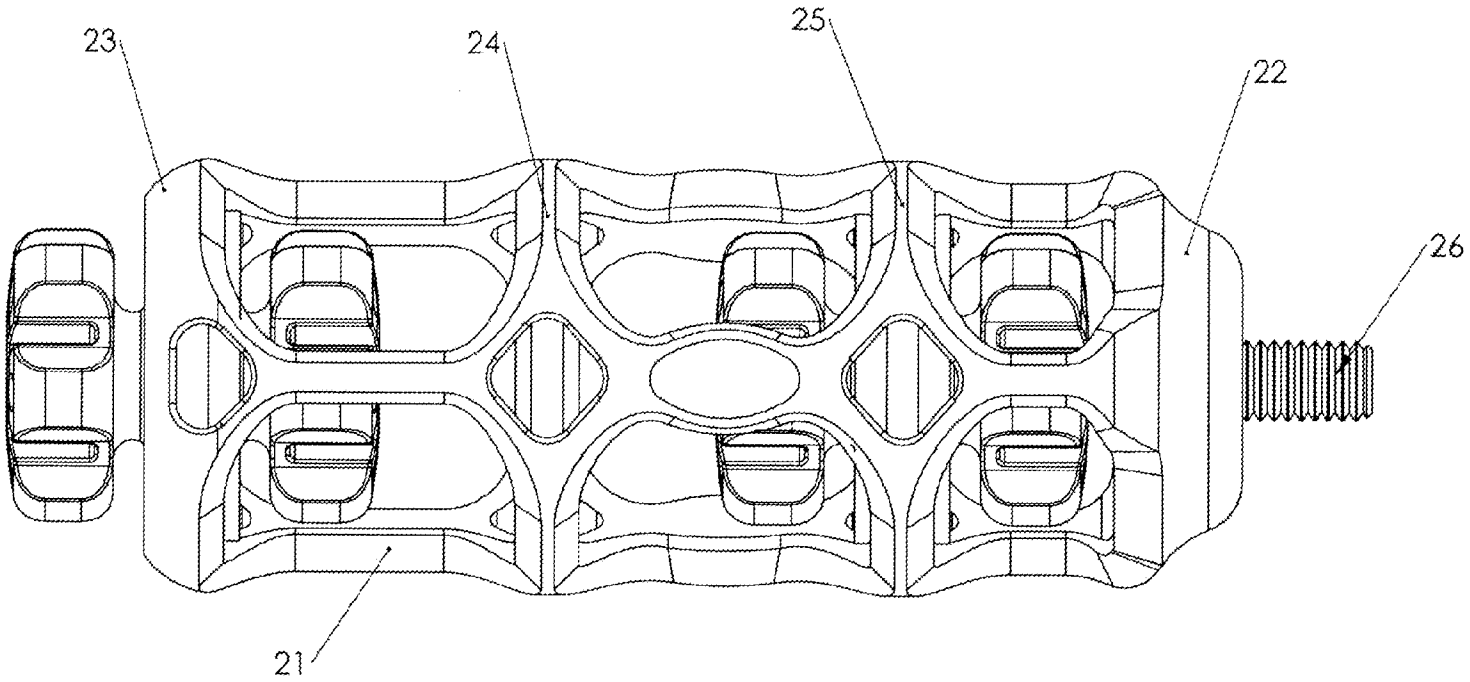
FIG. 4 is a side elevational view of the assembly shown in FIG. 3.
Figure 5:
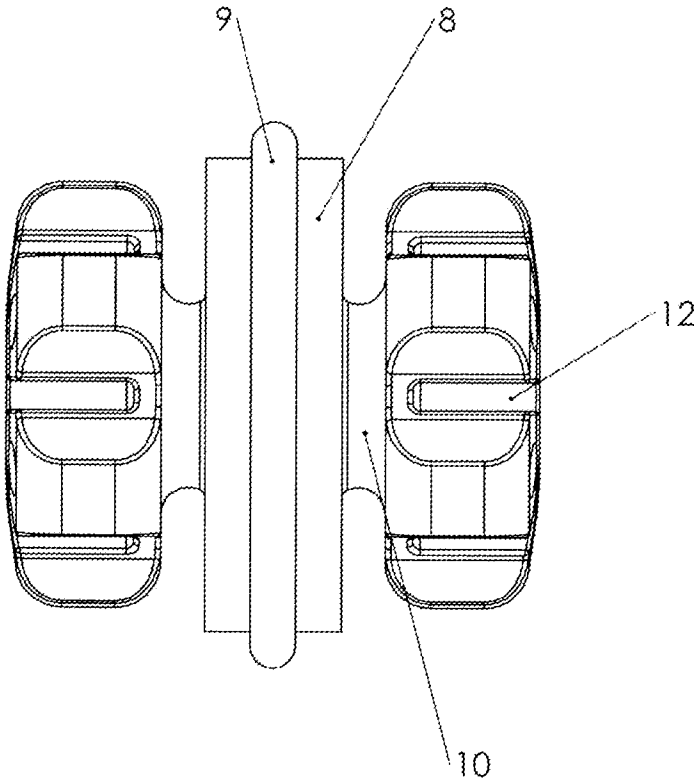
FIG. 5 is an elevational view of the device shown in FIG. 1.

In order to incorporate the vibration and dampening device, according to this invention, into an archery bow, an assembly such as shown in FIGS. 3 and 4 can be utilized and which includes substantially cylindrical housing 21 having base portion 22 disposed at one end of housing 21 and with the dampener supports 23, 24 and 25 spaced apart and disposed within housing 21. Although not shown in the drawings, each dampener support 23, 24 and 25 includes an inner groove adaptable to receive outer ring 9 of each vibration dampener. In order to complete the assembly shown in FIGS. 3 and 4, the vibration dampener, as shown in FIGS. 1 and 2, is manually asserted into housing 21 such that ring 9 engages the respective inner groove of dampener supports 23, 24 and 25. Attachment screw 26 extends outwardly from base portion 22 for purposes of attaching the dampener assembly to an archery bow.

Figure 7:
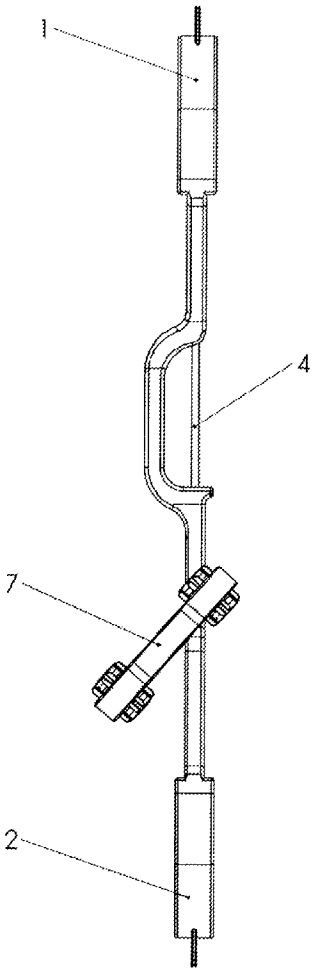

As shown in FIG. 6, vibration modifier 7 receives the dampeners in similar fashion as that shown in connection with the dampener assembly of FIGS. 3 and 4. The vibration and dampening device, according to this invention, is also adaptable to various other dampener assemblies and vibration modifiers in accordance with the desires of the archer. Also, as shown in FIG. 7, by simply rotating vibration modifier 7 angularly with respect to the archery bow, the vibration dampening characteristics are adjusted as desired.

The invention claimed is:

1. An archery bow vibration and dampening device comprising a base having a periphery and spaced sides, a stem extending outwardly from said base, at least one stud extending outwardly from the periphery of said stem, said stud comprising a V-shaped pedestal, said pedestal comprising outer free edges, side walls secured respectively to said free edges and extending angularly inward, said side walls comprising edges remote from said pedestal, a top wall secured to said edges of said side walls, and an outer ring extending around the periphery of said base between said sides.

2. The device according to claim 1 wherein multiple spaced studs extend outwardly around the periphery of said stein.

3. The device according to claim 1 wherein an opening is formed in said stud remote from said base.

4. The device according to claim 3 wherein a weight is disposed in said opening.

5. The device according to claim 4 wherein said weight is cylindrical in configuration.

6. The device according to claim 1 wherein said base is circular.

7. The device according to claim 1 wherein said device is rubber.

8. The device according to claim 1 wherein a cylindrical housing includes a dampener support, said dampener support comprises an inner groove, and said outer ring is disposed in said groove.

9. The device according to claim 8 wherein said cylindrical housing is rotatably secured to an archery bow.

* * * * *